United States Patent [19]

Stark

[11] 4,237,658

[45] Dec. 9, 1980

[54] DEVICE FOR USE IN POLISHING TABLE FACETS OF GEMS

[75] Inventor: Hanoch Stark, Ramat Hasharon, Israel

[73] Assignee: Hargem Ltd., Ramat Gan, Israel

[21] Appl. No.: 7,000

[22] Filed: Jan. 26, 1979

[51] Int. Cl.[3] ..... B24B 9/16

[52] U.S. Cl. ..... 51/122; 51/216 LP; 51/229

[58] Field of Search ..... 51/59 R, 121, 122, 124 R, 51/216 R, 216 LP, 217 S, 229, 283 R, 125, 125.5; 279/1 Q; 125/30 R

[56] References Cited

U.S. PATENT DOCUMENTS

| | | | |
|---|---|---|---|
| 515,595 | 2/1894 | Linden | 51/229 |
| 1,523,766 | 1/1925 | Gray | 51/229 |
| 1,954,422 | 4/1934 | McIntyre | 279/1 Q |
| 2,452,696 | 11/1948 | Stabler | 51/59 R |
| 2,797,534 | 7/1957 | Rouse | 51/122 |
| 3,043,060 | 7/1962 | Bell | 51/122 |
| 3,404,491 | 10/1968 | Emair | 51/229 |
| 3,863,396 | 2/1975 | Holt | 51/124 R |

FOREIGN PATENT DOCUMENTS

| | | | |
|---|---|---|---|
| 353952 | 5/1922 | Fed. Rep. of Germany | 51/124 R |

*Primary Examiner*—Gary L. Smith
*Assistant Examiner*—Robert P. Olszewski
*Attorney, Agent, or Firm*—Benjamin J. Barish

[57] ABSTRACT

A polishing device is described particularly useful for polishing table facets of gems, the device comprising a rotary polishing disc and a plurality of spring fingers mounted in cantilever fashion to overlie the polishing disc, with each spring finger including a pad formed with a socket adapted to receive a gem to be polished by the disc. A pressure bar urged by an electromagnet overlies the upper faces of all the spring fingers to apply a preselected, substantially uniform pressure to them during the polishing operation.

10 Claims, 3 Drawing Figures

DEVICE FOR USE IN POLISHING TABLE FACETS OF GEMS

BACKGROUND OF THE INVENTION

The present invention relates to devices for use in polishing table facets of gems.

Diamonds are usually polished by mounting them to a holder (sometimes called a "dop") which is pressed against a rotary-driven polishing disc. Less expensive faceted gems are usually polished by manually holding the gem against the polishing disc, or in the case of small gems, by mounting the gem to the end of a holder which is held against the polishing disc.

The present invention is directed to a device particularly useful in polishing table facets of gems in a simple and efficient manner.

SUMMARY OF THE INVENTION

According to a broad aspect of the present invention, there is provided a polishing device particularly useful for polishing table facets of gems, comprising a rotary polishing disc, and a spring finger mounted to overlie the polishing disc, the underface of the spring finger facing the polishing disc including a pad adapted to receive a gem to be polished, and to be pressed against the polishing disc by the spring finger.

Preferably, and in accordance with the preferred embodiment of the invention described below, there are a plurality of said spring fingers each mounted in cantilever fashion to overlie the polishing disc and each including a pad formed with a socket adapted to receive a gem to be polished by the polishing disc.

According to a further feature in the preferred embodiment of the invention described below, the device includes a pressure bar overlying the upper faces of all the spring fingers, and pressure-applying means applying a preselected substantially uniform pressure to the bar in the direction of the polishing disc.

Preferably, the pressure-applying means comprises an electromagnet having a magnetic core coupled to the pressure bar for applying thereto the preselected pressure, which pressure is variable by varying the current through the electromagnet.

According to a further feature in the described preferred embodiment, the device also includes oscillating means for oscillating the common mounting to oscillate all the spring fingers in a substantially radial direction with respect to the polishing disc.

According to yet another feature in the described preferred embodiment, the device includes means for applying to the polishing disc, first a polishing liquid for polishing the gems, then a rinsing liquid for rinsing the disc, then hot air for drying the disc.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
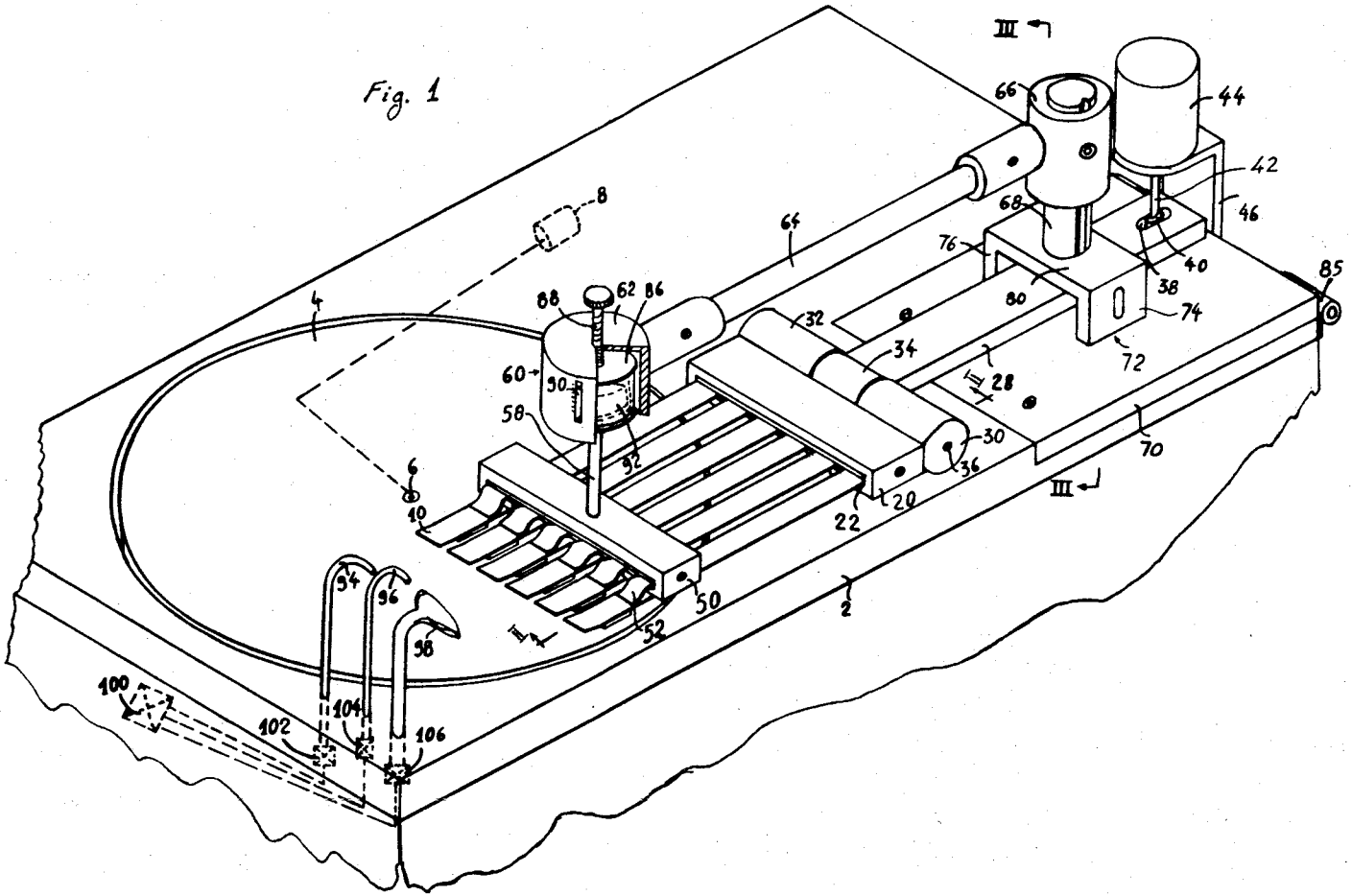
FIG. 1 is a three-dimensional view illustrating one form of polishing device constructed in accordance with the invention.

The polishing device illustrated in FIG. 1 comprises a base, generally designated 2, mounting a polishing disc 4 for rotation above its centre spindle 6. The disc is preferably of lead or aluminum, and the drive for rotating it is an electric motor mounted within the base as shown in broken lines at 8.

A plurality (in this case six) spring fingers 10 are mounted in cantilever fashion over the polishing disc 4, each spring finger adapted to receive a gem to be polished by the disc. The underside of the free end of each spring finger 10 carries a cushioning pad 12 (FIG. 2), such as of rubber. Each pad is fixed to its respective spring finger by any suitable means, such as by an adhesive or by a fastener, and is formed with a socket 14 receiving a gem 16, with the table 18 of the gem facing downwardly so as to be pressed into contact with the polishing disc 4.

Figure 2:
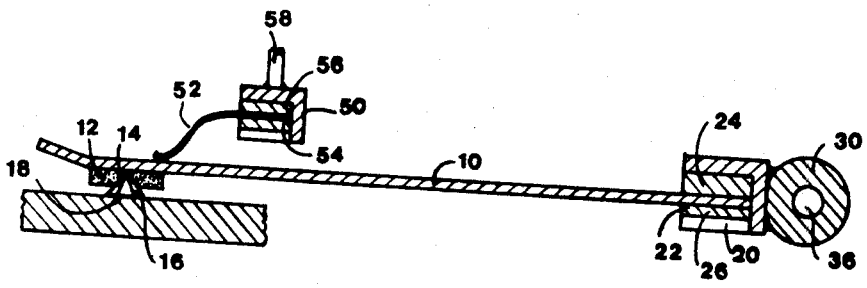
FIG. 2 is a sectional view along lines II—II of FIG. 1.

All the spring fingers 10 are supported in substantially coplanar relationship by means of a common mounting 20 in the form of a block having an elongated slot 22 receiving the ends of the fingers, which ends are pressed between strips of cushioning material 24, 26 (FIG. 2). Block 20 is pivotably mounted to an oscillating arm 28 by means of a hinge construction including a pair of spaced hinge elements 30, 32 fixed to block 20, and an intermediate hinge element 34 fixed to one end of arm 28, the hinge including a pin 36 passing through all the foregoing elements.

The opposite end of oscillating arm 28 is formed with a slot 38 elongated in the direction of the longitudinal axis of the arm. An eccentric bearing 40 is received within slot 38 and is rotated by a shaft 42 of an electric motor 44 mounted to base 2 by means of a bracket 46.

The free ends of the spring fingers 10 are pressed towards the polishing disc 4 by means of a pressure bar 50 extending transversely across all the spring fingers and overlying their upper faces. A plurality of leaf springs 52, one for each finger 10, are mounted between a pair of cushioning strips 54, 56 (FIG. 2) in pressure bar 50, their free ends being downwardly bent and engaging the upper face of the fingers 10 adjacent to their pads 12 mounting the gems 16. Pressure bar 50 is fixed to the end of a vertical stem 58, the opposite end of which stem is attached to an electromagnet, generally designated 60.

Figure 3:
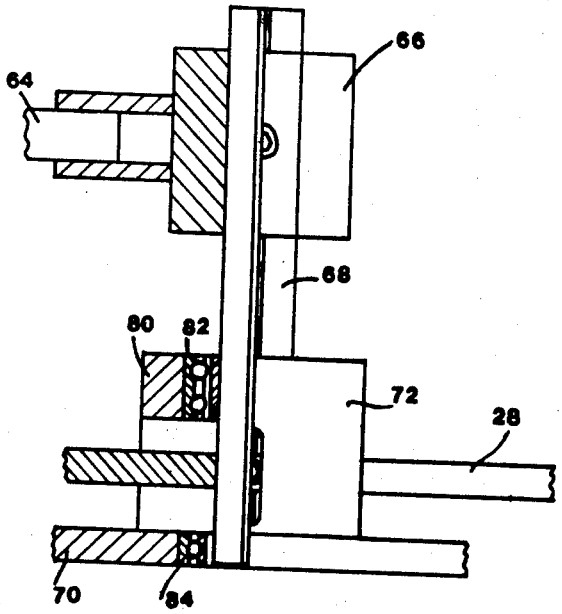
FIG. 3 is a sectional view along lines III—III of FIG. 1.

Electromagnet 60 includes a housing 62 fixed to one end of an arm 64, the opposite end of the arm being provided with a sleeve 66 which is keyed to a vertical shaft 68, the lower end of the shaft being keyed to the oscillating arm 28 so as to be oscillated with it. In order to support the vertical shaft 68 during its oscillations, section 70 of the base 2 has fixed thereto a U-shaped brace 72 having a pair of legs 74, 76 straddling the oscillating arm 28, and a bridging leg 80 formed with a central opening lined with a bearing 82 (FIG. 3) rotatably supporting the vertical shaft 68. The lower end of the shaft is rotatably supported by another bearing 84 carried on section 70 of the base 2.

Section 70 is pivotably supported to base 2 by means of a hinge 85. This section also carries the mounting bracket 46 for the motor 44, so as to permit the whole assembly supported by this section, including the motor 44, vertical shaft 68, electromagnet 60, pressure bar 50, and spring fingers 10, to be swung upwardly from the polishing disc 4, as will be described more particularly below.

The field 86 of the electromagnet 60 is suspended from the top wall of its housing 62 by means of a thumb screw 88 to permit the manual adjustment of the field with respect to the housing. The housing is formed with a vertical slot 90 facing frontwardly of the device to permit precise presetting of the field 86 within the housing. An electromagnetic core, shown in broken lines at 92, is disposed within the field 86 and is secured to the stem 58 carrying the pressure bar 50.

It will thus be seen that the pressure applied by bar 50 to the spring fingers 10 can be pre-set by the use of thumb screw 68, and can also be varied by controlling the magnitude of current passed through the electomagnetic field 86.

The illustrated polishing device further includes a first nozzle 94 applying a polishing liquid (such as aluminum oxide mixed in water) to the polishing disc 4 for use in polishing the gems 16 carried on the underside of the spring fingers 10. The device further includes a second nozzle 96 applying a rinsing liquid (such as water) to the polishing disc for rinsing the disc of the polishing liquid; and a third nozzle 98 applying hot air to the polishing disc for drying the disc after it has been rinsed by the rinsing liquid. The nozzles are controlled by a controller, schematically shown at 100, which sequentially actuates on-off valves, 102, 104, 106 in the input lines of these nozzles.

The device is used in the following manner:

First, the whole assembly including motor 44 and its bracket 46, vertical shaft 68, oscillating arm 28, spring fingers 10, and electromagnet 60, may be swung upwardly about hinge 85 in order to load the gems 16 onto the pads 12 at the undersides of the spring fingers. After the assembly is returned to its normal operating position, as illustrated in FIG. 1, thumb screw 88 may be manipulated to pre-set the amount of pressure that block 50 is to apply to the spring fingers during the polishing operation. This pressure can also be varied, as indicated above, by controlling the magnitude of current supplied to the field of the electromagnet 60.

The main drive motor 8 may then be energized to rotate the polishing disc 4, and the oscillating motor 44 may be energized to cause it, via its eccentric bearing 40 received in slot 38 at the end of oscillating arm 28, to oscillate arm 28 about the axis of vertical shaft 68. Since arm 28 is keyed to the vertical shaft 68, the latter is also oscillated, to thereby oscillate the electromagnet 60 and the pressure block 50 with the spring fingers 10, the latter being oscillated in the radial direction with respect to the polishing disc 4.

During the operation of the device, the polishing liquid is first applied to the polishing disc 4 via nozzle 94; then this polishing liquid is rinsed from the disc by a rinsing liquid applied via nozzle 96; and finally the polishing disc is dried by hot air applied via nozzle 98. The sequence, and also the time duration, of application of these fluids via nozzles 94, 96, 98 are pre-set by controller 100 which controls the on-off valves 102, 104, 106 in the input lines to these nozzles. Controller 100 may be any of the known electronic, mechanical, or hydraulic controllers commonly used for controlling valves or other devices in a sequential manner.

While the invention has been described with respect to one preferred embodiment, it will be appreciated that many variations, modifications and other applications may be made.

What is claimed is:

1. A polishing device particularly useful for polishing table facets of gems, comprising a rotary polishing disc, a plurality of said spring fingers each mounted in cantilever fashion to overlie the polishing disc and each including a pad formed with a socket adapted to receive a gem to be polished by the polishing disc and to be pressed against the polishing disc by the spring finger: a pressure bar overlying the upper faces of all the spring fingers; and pressure-applying means applying a pre-selected substantially uniform pressure to the bar in the direction of the polishing disc.

2. A polishing device according to claim 1, wherein said pressure-applying means comprises an electromagnet having a magnetic core coupled to the pressure bar for applying thereto the pre-selected pressure, which pressure is variable by varying the current through the electro-magnet.

3. A polishing device according to claim 1, wherein all said spring fingers extend parallel to each other and are mounted at one end to a common mounting.

4. A polishing device according to claim 3, further including oscillating means for oscillating the common mounting to oscillate all the spring fingers in a substantially radial direction with respect to the polishing disc.

5. A polishing device according to claim 4, wherein said oscillating means comprises a rotary motor having an eccentric coupling to said common mounting.

6. A polishing device according to claim 5, wherein said eccentric coupling comprises an oscillating arm connected at one end to said common mounting for the spring fingers, said arm being oscillated at its opposite end by said rotary motor, and being pivotable at an intermediate point with respect to said polishing disc.

7. A polishing device according to claim 6, wherein said pressure bar is coupled to said oscillating arm to be oscillated therewith.

8. A polishing device according to claim 7, wherein said oscillating arm, spring fingers and pressure bar are all supported on a pivotable support which may be swung upwardly with respect to the polishing disc in order to apply the gems to the pads on the underside of the spring fingers.

9. A polishing device according to claim 1, further including means for applying to the polishing disc, first a polishing liquid for polishing the gems, then a rinsing liquid for rinsing the disc, then hot air for drying the disc.

10. A polishing device according to claim 9, wherein said latter means comprises a first nozzle for applying the polishing liquid, a second nozzle for applying the rinsing liquid, a third nozzle for applying the hot air, a valve for each nozzle, and a controller controlling said valves in sequence.

* * * * *